US011060244B2

(12) United States Patent
Schmitz et al.

(10) Patent No.: US 11,060,244 B2
(45) Date of Patent: Jul. 13, 2021

(54) ARTIFICIAL TURF AND PRODUCTION METHOD

(71) Applicant: Polytex Sportbelage Produktions-GmbH, Grefrath (DE)

(72) Inventors: Dirk Schmitz, Weeze (DE); Dirk Sander, Kerken (DE); Oliver Wagener, Krefeld (DE); Stephan Sick, Willich (DE)

(73) Assignee: Polytex Sportbelage Produktions-GmbH, Grefrath (DE)

( * ) Notice: Subject to any disclaimer, the term of this patent is extended or adjusted under 35 U.S.C. 154(b) by 17 days.

(21) Appl. No.: 15/553,231

(22) PCT Filed: Dec. 3, 2015

(86) PCT No.: PCT/EP2015/078512
§ 371 (c)(1),
(2) Date: Aug. 24, 2017

(87) PCT Pub. No.: WO2016/173683
PCT Pub. Date: Nov. 3, 2016

(65) Prior Publication Data

US 2018/0058017 A1 Mar. 1, 2018

(30) Foreign Application Priority Data

Apr. 27, 2015 (EP) ..... 15165199

(51) Int. Cl.
*E01C 13/08* (2006.01)
*D01F 1/07* (2006.01)
(Continued)

(52) U.S. Cl.
CPC ..... *E01C 13/08* (2013.01); *D01F 1/07* (2013.01); *D01F 6/46* (2013.01); *D01F 6/90* (2013.01);
(Continued)

(58) Field of Classification Search
CPC ..... D01F 1/07; B29C 48/0018; B29C 55/30; B29B 9/00; E01C 13/08; D10B 2505/202
See application file for complete search history.

(56) References Cited

U.S. PATENT DOCUMENTS 3,739,055 A * 6/1973 Toshiyuki Ueda ..... D01F 6/60 264/342 RE
4,446,307 A * 5/1984 Shirk ..... C08G 59/04 528/406
(Continued)

FOREIGN PATENT DOCUMENTS

AU 2015392708 A1 9/2017
CN 101994167 A 3/2011
(Continued)

OTHER PUBLICATIONS

Yamamoto, Akira, English translation of JP2000303257, Oct. 31, 2000 (Year: 2000).*
(Continued)

*Primary Examiner* — Anthony Calandra
*Assistant Examiner* — Eric T Chen
(74) *Attorney, Agent, or Firm* — Harness, Dickey & Pierce, P.L.C.

(57) ABSTRACT

The method includes creating a polymer mixture, wherein the polymer mixture includes a stabilizing polymer, a bulk polymer, a flame retardant polymer combination, and a compatibilizer. The stabilizing polymer and the bulk polymer are immiscible. The stabilizing polymer includes fibers surrounded by the compatibilizer within the bulk polymer. The stabilizing polymer is aramid. The flame retardant polymer combination is a mixture of triazin and melamine. The method further includes extruding the polymer mixture into a monofilament. The method further includes quenching the monofilament. The method further includes reheating the monofilament. The method further includes stretching the
(Continued)

reheated monofilament to align the fibers relative to each other and to form the monofilament into an artificial turf fiber. The method further includes incorporating the artificial turf fiber into an artificial turf backing.

19 Claims, 12 Drawing Sheets

(51) Int. Cl.
*D01F 6/46* (2006.01)
*D01F 6/90* (2006.01)
*D01F 6/92* (2006.01)

(52) U.S. Cl.
CPC ..... *D01F 6/92* (2013.01); *D10B 2505/202* (2013.01)

(56) References Cited

U.S. PATENT DOCUMENTS

| | | | | |
|---|---|---|---|---|
| 6,150,020 | A * | 11/2000 | Dharmadhikary | C08L 23/12 264/328.1 |
| 2010/0173102 | A1 | 7/2010 | Van Reijen | |
| 2012/0125474 | A1 | 5/2012 | Frenken et al. | |
| 2017/0275139 | A1 | 9/2017 | Turek et al. | |

FOREIGN PATENT DOCUMENTS

| | | | | |
|---|---|---|---|---|
| EP | 2395135 | A1 | 12/2011 | |
| EP | 3088575 | A1 | 11/2016 | |
| EP | 3289118 | A1 | 3/2018 | |
| JP | H09220781 | A * | 8/1997 | B32B 27/12 |
| JP | 2000-303257 | A | 10/2000 | |
| JP | 3-480543 | B2 | 12/2003 | |

OTHER PUBLICATIONS

Du Pont, "Kevlar Aramid Fiber: Technical Guide", (2017), https://www.dupont.com/content/dam/dupont/products-and-services/fabrics-fibers-and-nonwovens/fibers/documents/Kevlar_Technical_Guide_0319.pdf (Year: 2017).*

Lai, Xuejun, et al. "Synergistic effect between a tri azine-based macromolecule and melamine pyrophosphate in flame retardant polypropylene." Polymer Composites 33.1 (2012): 35-43. (Year: 2012).*

Fukushima Takashi, English translation of JPH09220781 (A), Aug. 26, 1997 (Year: 1997).*

International Search Report PCT/ISA/210 for International Application No. PCT/EP2015/078512 dated Mar. 2, 2016.

Written Opinion of the International Searching Authority PCT/ISA/237 for International Application No. PCT/EP2015/078512 dated Mar. 2, 2016.

Office Communication for European Application No. 15 805 153.2 dated Nov. 23, 2018.

International Preliminary Report for Application No. PCT/EP2015/078512 dated Nov. 9, 2017.

Japanese Reasons for Rejection for corresponding Application No. 2019-024207, dated Mar. 4, 2020, English translation thereof.

New Zealand Examination Report dated Sep. 28, 2020 for corresponding New Zealand Application No. 734833.

* cited by examiner

ARTIFICIAL TURF AND PRODUCTION METHOD

CROSS-REFERENCE TO RELATED APPLICATIONS

This application is a national phase under 35 U.S.C. § 371 of PCT International Application No. PCT/EP2015/078512 which has an International filing date of Dec. 3, 2015, which claims priority to European Application No. 15165199.9, filed Apr. 27, 2015, the entire contents of each of which are hereby incorporated by reference.

FIELD OF THE INVENTION

The invention relates to artificial turf and the production of artificial turf which is also referred to as synthetic turf. The invention further relates to the production of fibers that imitate grass, and in particular a product and a production method for artificial turf fibers based on polymer blends and of the artificial turf carpets made from these artificial turf fibers.

BACKGROUND AND RELATED ART

Artificial turf or artificial grass is surface that is made up of fibers which is used to replace grass. The structure of the artificial turf is designed such that the artificial turf has an appearance which resembles grass. Typically artificial turf is used as a surface for sports such as soccer, American football, rugby, tennis, golf, for playing fields, or exercise fields. Furthermore artificial turf is frequently used for landscaping applications.

An advantage of using artificial turf is that it eliminates the need to care for a grass playing or landscaping surface, like regular mowing, scarifying, fertilizing and watering. Watering can be e.g. difficult due to regional restrictions for water usage. In other climatic zones the re-growing of grass and re-formation of a closed grass cover is slow compared to the damaging of the natural grass surface by playing and/or exercising on the field. Artificial turf fields though they do not require a similar attention and effort to be maintained, may require some maintenance such as having to be cleaned from dirt and debris and having to be brushed regularly. This may be done to help fibers stand-up after being stepped down during the play or exercise. Throughout the typical usage time of 5-15 years it may be beneficial if an artificial turf sports field can withstand high mechanical wear, can resist UV, can withstand thermal cycling or thermal ageing, can resist inter-actions with chemicals and various environmental conditions. It is therefore beneficial if the artificial turf has a long usable life, is durable, and keeps its playing and surface characteristics as well as appearance throughout its usage time.

United States Patent application US 2010/0173102 A1 discloses an artificial grass that is characterized in that the material for the cladding has a hyprophilicity which is different from the hyprophilicity of the material which is used for the core.

SUMMARY

The invention provides for a method of manufacturing artificial turf and an artificial turf manufactured according to the method. Embodiments are given in the dependent claims In one aspect the invention provides for a method of manufacturing artificial turf carpet. The method comprises the step of creating a polymer mixture. The polymer mixture as used herein encompasses a mixture of different types of polymers and also possibly with various additives added to the polymer mixture. The term 'polymer mixture' may also be replaced with the term 'master batch' or 'compound batch'.

In one aspect the invention provides for a method of manufacturing artificial turf. The method comprises the step of creating a polymer mixture. The polymer mixture comprises a stabilizing polymer, a bulk polymer, a flame-retardant polymer combination and at least one compatibilizer. The bulk polymer may for instance be a mixture of one or more polymers with other components added. For example coloring or other additives could be added to the bulk polymer. The stabilizing polymer and the bulk polymer are immiscible. By stating that the stabilizing polymer and the bulk polymer are immiscible it is meant that the stabilizing polymer is immiscible with at least a majority of the components that make up the bulk polymer. For example the bulk polymer could be made of one polymer that is immiscible with the stabilizing polymer and then have a smaller portion of the bulk polymer made from a second polymer that is or may be at least partially immiscible with the stabilizing polymer.

The stabilizing polymer comprises fibers surrounded by the compatibilizer within the bulk polymer. This enables the fibers of the bulk polymer to be mixed into the bulk polymer. The stabilizing polymer is aramid. The flame-retardant polymer is a combination of a mixture of triazine and melamine. The polymer aramid has very good structural and temporal temperature stability. Aramid is a polar molecule. Some variants of aramid are also known by the trade name of Kevlar. As mentioned before, the bulk polymer may be a mixture of different polymers. In one example the bulk polymer is a pure polymer of one type. In another example the bulk polymer is a blend of different polymers. In another example the bulk polymer may be a mixture of both non-polar and polar polymers. In this case the majority of the polymers used to make up the bulk polymer are non-polar.

The flame-retardant polymer is made from a mixture of triazine and melamine. Both triazine and melamine are non-polar molecules. The triazine and melamine are therefore immiscible with the bulk polymer. In the case of fire the triazine and melamine combination forms an intumescence layer on the surface of a monofilament which extinguishes the fire. The combination of the flame-retardant polymer with the stabilizing polymer increases the fire resistance of fibers formed from the polymer mixture. This is because the aramid has extremely good thermal stability and even if the bulk polymer is melting or burning the aramid will retain its shape and prevent any fibers from deforming or losing their shape and melting completely. The intumescence layer covers the surface of any artificial turf fibers or monofilaments and thus if the monofilament or fibers used to make the artificial turf melt then the intumescence layer is less effective in stopping a fire. The stabilizing polymer therefore increases the effectiveness of the intumescence layer in stopping a fire.

The method further comprises the step of extruding the polymer mixture into a monofilament. The method further comprises the step of quenching the monofilament. The method further comprises the step of reheating the monofilament. The method further comprises the step of stretching the reheated monofilament to align the fibers relative to each other and to form the monofilament into an artificial turf fiber. The aramid is much more thermally stable than the thermal polymers or polymers used to make the polymer mixture. The stretching of the reheated monofilament causes these fibers to line up better than when they were extruded. Having the fibers aligned relative to each other provides additional stability when a monofilament is burning or being heated by a fire. The stretching process therefore further enhances the effectiveness of the flame-retardant polymer combination to function as an intumescence layer.

In another embodiment, the stabilizing polymer comprises aramid fibers.

In another embodiment the stabilizing polymer is a polar polymer.

In another embodiment the flame-retardant polymer combination is a non-polar mixture or blend or combination of polymers.

In another embodiment the bulk polymer is a non-polar polymer or a combination of multiple non-polar polymers.

In another embodiment the bulk polymer is a combination of both polar and non-polar polymers. The bulk polymer may have a compatibilizer to enable the non-polar and polar polymers to be mixed. In the case where the bulk polymer is made of a mixture of non-polar and polar polymers the majority of the bulk polymer by weight is non-polar.

In another embodiment the polymer mixture comprises less than or equal to 8% stabilizing polymer by weight.

In another embodiment the polymer mixture comprises less than or equal to 10% stabilizing polymer by weight.

In another embodiment the polymer mixture comprises less than or equal to 12% by weight stabilizing polymer.

In another embodiment the polymer mixture comprises less than or equal to 15% stabilizing polymer by weight.

In another embodiment the polymer mixture comprises less than or equal to 20% flame-retardant polymer combination by weight.

In another embodiment the polymer mixture comprises less than or equal to 22% flame-retardant polymer combination by weight.

In another embodiment the polymer mixture comprises less than or equal to 25% flame-retardant polymer combination by weight.

In another embodiment the polymer mixture comprises less than or equal to 27% flame-retardant polymer combination by weight.

In another embodiment the polymer mixture comprises less than or equal to 29% flame-retardant polymer combination by weight, In another embodiment the ratio of triazine to melamine by weight in the flame-retardant polymer combination is 1.8.

In another embodiment the ratio of triazine to melamine by weight in the flame-retardant polymer combination is 1.9.

In another embodiment the ratio of triazine to melamine by weight in the flame-retardant polymer combination is 2.0.

In another embodiment the ratio of triazine to melamine by weight in the flame-retardant polymer combination is 2.

In another embodiment the ratio of triazine to melamine by weight in the flame-retardant polymer combination is 2.1.

In another embodiment the ratio of triazine to melamine by weight in the flame-retardant polymer combination is 2.2.

In the above embodiments where the ratio of triazine to melamine is given the use of a decimal point after a number implies a range. For example the use of the value 1.8 implies a ratio between 1.75 and 1.85. The value 1.9 implies a range of 1.85 to 1.95. The value 2.0 implies a range between 1.95 and 2.05. The value 2.1 implies a range between 2.05 and 2.15. The value 2.2 implies a range between 2.15 and 2.25.

In another embodiment the bulk polymer comprises any one of the following: a non-polar polymer, a polyolefin polymer, a thermoplastic polyolefin polymer, a polyethylene polymer, a polypropylene polymer, a polyimide polymer, a polyethylene polymer blend, and mixtures thereof.

In another embodiment the bulk polymer comprises a first polymer, a second polymer, and the compatibilizer. The first polymer and the second polymer are immiscible. The first polymer forms polymer beads surrounded by the compatibilizer within the second polymer. The term 'polymer bead' or 'beads' may refer to a localized region, such as a droplet, of a polymer that is immiscible in the second polymer. The polymer beads may in some instances be round or spherical or oval-shaped, but they may also be irregularly-shaped. In some instances the polymer bead will typically have a size of approximately 0.1 to 3 micrometer, preferably 1 to 2 micrometer in diameter. In other examples the polymer beads will be larger. They may for instance have a size with a diameter of a maximum of 50 micrometer.

In one embodiment the bulk polymer by weight comprises more second polymer than first polymer.

In another embodiment the second polymer is a non-polar polymer and the first polymer is a polar polymer.

This embodiment may be beneficial because it may provide a way of tailoring the texture and feel of the monofilaments used to make the artificial turf.

In another embodiment stretching the reheated monofilament deforms the polymer beads into thread-like regions. In this embodiment the stretching of the monofilament not only aligns the aramid fibers but also stretches the polymer beads into thread-like regions which may also aid in changing the structure of the monofilament.

The method further comprises the step of stretching the reheated filament to deform the polymer beads into thread-like regions and to form the monofilament into an artificial turf fiber. In this step the monofilament is stretched. This causes the monofilament to become longer and in the process the polymer beads are stretched and elongated. Depending upon the amount of stretching the polymer beads are elongated more.

In another embodiment the polymer bead comprises crystalline portions and amorphous portions. Stretching the polymer beads into thread-like regions causes an increase in the size of the crystalline portions relative to the amorphous portions.

In another embodiment the method further comprises the step of creating the polymer mixture. Creating the polymer mixture comprises the step of forming an initial mixture by mixing the stabilizing polymer with the compatibilizer. Creating the polymer mixture further comprises the step of heating the initial mixture. Creating the polymer mixture further comprises the step of extruding the initial mixture. Creating the polymer mixture further comprises the step of granulating the extruded initial mixture. Creating the polymer mixture further comprises the step of mixing the granulated initial mixture with the bulk polymer and the flame-retardant polymer combination. Creating the polymer mixture further comprises the step of heating the granulated initial mixture with the bulk polymer and the flame-retardant polymer combination to form the polymer mixture.

In another embodiment the bulk polymer comprises 1-30% by weight of the first polymer.

In another embodiment the bulk polymer comprises 1-20% by weight of the first polymer.

In another embodiment the bulk polymer comprises 5-10% by weight of the first polymer.

In another embodiment the first polymer is any one of the following: a polar polymer, a polyimide; polyethylene terephthalate (PET), polybutylene terephthalate (PBT), and combinations thereof.

In some examples the artificial turf backing is a textile or a textile matt.

The incorporation of the artificial turf fiber into the artificial turf backing could for example be performed by tufting the artificial turf fiber into an artificial turf backing and binding the tufted artificial turf fibers to the artificial turf backing. For instance the artificial turf fiber may be inserted with a needle into the backing and tufted the way a carpet may be. If loops of the artificial turf fiber are formed then may be cut during the same step. The method further comprises the step of binding the artificial turf fibers to the artificial turf backing. In this step the artificial turf fiber is bound or attached to the artificial turf backing. This may be performed in a variety of ways such as gluing or coating the surface of the artificial turf backing to hold the artificial turf fiber in position. This for instance may be done by coating a surface or a portion of the artificial turf backing with a material such as latex or polyurethane.

The incorporation of the artificial turf fiber into the artificial turf backing could for example be performed alternatively by weaving the artificial turf fiber into artificial turf backing (or fiber mat) during manufacture of the artificial turf carpet. This technique of manufacturing artificial turf is known from United States patent application US 20120125474 A1.

In some examples the stretched monofilament may be used directly as the artificial turf fiber. For example the monofilament could be extruded as a tape or other shape.

In other examples the artificial turf fiber may be a bundle or group of several stretched monofilament fibers is in general cabled, twisted, or bundled together. In some cases the bundle is rewound with a so called rewinding yarn, which keeps the yarn bundle together and makes it ready for the later tufting or weaving process.

The monofilaments may for instance have a diameter of 50-600 micrometer in size. The yarn weight may typically reach 50-3000 dtex.

Embodiments may have the advantage that the second polymer and any immiscible polymers may not delaminate from each other. The thread-like regions are embedded within the second polymer. It is therefore impossible for them to delaminate. The use of the first polymer and the second polymer enables the properties of the artificial turf fiber to be tailored. For instance a softer plastic may be used for the second polymer to give the artificial turf a more natural grass-like and softer feel. A more rigid plastic may be used for the first polymer or other immiscible polymers to give the artificial turf more resilience and stability and the ability to spring back after being stepped or pressed down.

A further advantage may possibly be that the thread-like regions are concentrated in a central region of the monofilament during the extrusion process. This leads to a concentration of the more rigid material in the center of the monofilament and a larger amount of softer plastic on the exterior or outer region of the monofilament. This may further lead to an artificial turf fiber with more grass-like properties.

A further advantage may be that the artificial turf fibers have improved long term elasticity. This may require reduced maintenance of the artificial turf and require less brushing of the fibers because they more naturally regain their shape and stand up after use or being trampled.

In another embodiment the polymer bead comprises crystalline portions and amorphous portions. The polymer mixture was likely heated during the extrusion process and portions of the first polymer and also the second polymer may have a more amorphous structure or a more crystalline structure in various regions. Stretching the polymer beads into the thread-like regions may cause an increase in the size of the crystalline portions relative to the amorphous portions in the first polymer. This may lead for instance to the first polymer to become more rigid than when it has an amorphous structure. This may lead to an artificial turf with more rigidity and ability to spring back when pressed down. The stretching of the monofilament may also cause in some cases the second polymer or other additional polymers also to have a larger portion of their structure become more crystalline.

In a specific example of this the first polymer could be polyamide and the second polymer could be polyethylene. Stretching the polyamide will cause an increase in the crystalline regions making the polyamide stiffer. This is also true for other plastic polymers.

In another embodiment the polymer mixture or master batch is created by mixing together the contents of the bulk polymer, the stabilizing polymer, and a flame retardant polymer in granular or power form and then the mixture is heated to form the polymer mixture. Additional additives may also be added at this time.

In another embodiment the bulk polymer is first made in a granular form and then added to the other contents of the polymer mixture. The creating of the bulk polymer comprises the step of forming a first mixture by mixing the first polymer with the compatibilizer. The creation of the bulk polymer further comprises the step of heating the first mixture. The step of creating the bulk polymer further comprises the step of extruding the first mixture. The creating of the bulk polymer further comprises the step of extruding the first mixture. The creation of the bulk polymer further comprises the steps of granulating the extruded first mixture. The creating of the bulk polymer further comprises the step of mixing the granulated first mixture with the second polymer. The creation of the bulk polymer further comprises the step of heating the granulated first mixture with the second polymer to form the bulk polymer. This particular method of creating the bulk polymer may be advantageous because it enables very precise control over how the first polymer and compatibilizer are distributed within the second polymer. For instance the size or shape of the extruded first mixture may determine the size of the polymer beads that are then formed in the in the polymer mixture.

The polymer mixture and/or the bulk polymer may be fabricated using a so called one-screw extrusion method may be used. As an alternative to this the polymer mixture and/or bulk polymer may also be created by putting all of the components that make it up together at once. For instance the first polymer, the second polymer and the compatibilizer could be all added together at the same time for making the bulk polymer. For the polymer mixture, the compatibilizer, the stabilizing polymer, the bulk polymer, the flame retardant polymer could be added together at one time. Other ingredients such as additional polymers or other additives could also be put together then also. The amount of mixing of the polymer mixture and/or bulk polymer could then be increased for instance by using a two-screw feed for the extrusion. In this case the desired distribution of the polymer beads can be achieved by using the proper rate or amount of mixing.

In another embodiment the bulk polymer comprises at least a third polymer. The third polymer is immiscible with the second polymer. The third polymer further forms the polymer beads surrounded by the compatibilizer within the second polymer.

In another embodiment the creating of the bulk polymer comprises the step of forming a first mixture by mixing the first polymer and the third polymer with the compatibilizer. The creating of the bulk polymer further comprises the step of heating the first mixture. The creating of the bulk polymer first comprises the step of extruding the first mixture. The creating of the bulk polymer further comprises the step of granulating the extruded first mixture. The creating of the bulk polymer further comprises mixing the first mixture with the second polymer. The creating of the bulk polymer further comprises the step of heating the first mixture with the second polymer to form the bulk polymer. This method may provide for a precise means of making the bulk polymer and controlling the size and distribution of the polymer beads using two different polymers. As an alternative the first polymer could be used to make a granulate with the compatibilizer separately from making the third polymer with the same or a different compatibilizer. The granulates could then be mixed with the second polymer to make the bulk polymer.

As an alternative to this the polymer mixture could be made by adding the first polymer, a second polymer, the third polymer and the compatibilizer all together at the same time to the other contents of the polymer mixture and then mixing them more vigorously. For instance a two-screw feed could be used for the extruder.

In another embodiment the third polymer is a polar polymer.

In another embodiment the third polymer is polyamide.

In another embodiment the third polymer is polyethylene terephthalate, which is also commonly abbreviated as PET.

In another embodiment the third polymer is polybutylene terephthalate, which is also commonly abbreviated as PBT.

In another embodiment the polymer mixture or the bulk polymer comprises between 1% and 30% by weight the first polymer and the third polymer combined. In this example the balance of the weight may be made up by such components as the second polymer, the compatibilizer, and any other additional additives put into the polymer mixture or the bulk polymer.

In another embodiment the polymer mixture or the bulk polymer comprises between 1 and 20% by weight of the first polymer and the third polymer combined. Again, in this example the balance of the weight of the polymer mixture or the bulk polymer may be made up by the second polymer, the compatibilizer, and any other additional additives.

In another embodiment the polymer mixture or the bulk polymer comprises between 5% and 10% by weight of the first polymer and the third polymer combined. Again in this example the balance of the weight of the polymer mixture or the bulk polymer may be made up by the second polymer, the compatibilizer, and any other additional additives.

In another embodiment the polymer mixture or the bulk polymer comprises between 1% and 30% by weight the first polymer. In this example the balance of the weight may be made up for example by the second polymer, the compatibilizer, and any other additional additives.

In another embodiment the polymer mixture or the bulk polymer comprises between 1% and 20% by weight of the first polymer. In this example the balance of the weight may be made up by the second polymer, the compatibilizer, and any other additional additives mixed into the polymer mixture or the bulk polymer.

In another embodiment the polymer mixture or the bulk polymer comprises between 5% and 10% by weight of the first polymer. This example may have the balance of the weight made up by the second polymer, the compatibilizer, and any other additional additives mixed into the polymer mixture or the bulk polymer.

In another embodiment the first polymer is a polar polymer.

In another embodiment the first polymer is polyamide.

In another embodiment the first polymer is polyethylene terephthalate which is commonly known by the abbreviation PET.

In another embodiment the first polymer is polybutylene terephthalate which is also known by the common abbreviation PBT.

In another embodiment the second polymer is a non-polar polymer.

In another embodiment the second polymer is polyethylene.

In another embodiment the second polymer is polypropylene.

In another embodiment the second polymer is a mixture of the aforementioned polymers which may be used for the second polymer.

In another embodiment the compatibilizer is any one of the following: a maleic acid grafted on polyethylene or polyamide; a maleic anhydride grafted on free radical initiated graft copolymer of polyethylene, SEBS, EVA, EPD, or polyproplene with an unsaturated acid or its anhydride such as maleic acid, glycidyl methacrylate, ricinoloxazoline maleinate; a graft copolymer of SEBS with glycidyl methacrylate, a graft copolymer of EVA with mercaptoacetic acid and maleic anhydride; a graft copolymer of EPDM with maleic anhydride; a graft copolymer of polypropylene with maleic anhydride; a polyolefin-graft-polyamidepolyethylene or polyamide; and a polyacrylic acid type compatibilizer.

In another embodiment the polymer mixture or the bulk polymer comprises between 80-90% by weight of the second polymer. In this example the balance of the weight may be made up by the first polymer, possibly the second polymer if it is present in the polymer mixture or the bulk polymer, the compatibilizer, and any other chemicals or additives added to the polymer mixture or the bulk polymer.

In another embodiment the polymer mixture or the bulk polymer further comprises any one of the following: a wax, a dulling agent, a ultraviolet stabilizer, a flame retardant, an anti-oxidant, a pigment, and combinations thereof. These listed additional components may be added to the polymer mixture or the bulk polymer to give the artificial turf fibers other desired properties such as being flame retardant, having a green color so that the artificial turf more closely resembles grass and greater stability in sunlight.

In another embodiment creating the artificial turf fiber comprises weaving the monofilament into the artificial turf fiber. That is to say in some examples the artificial turf fiber is not a single monofilament but a combination of a number of fibers.

In another embodiment the artificial turf fiber is a yarn.

In another embodiment the method further comprises bundling stretched monofilaments together to create the artificial turf fiber.

In another embodiment the method further comprises weaving, bundling, or spinning multiple monofilaments together to create the artificial turf fiber. Multiple, for example 4 to 8 monofilaments, could be formed or finished into a yarn.

In another aspect the invention provides for an artificial turf manufacture according to any one of the aforementioned methods.

In another aspect the invention provides for an artificial turf comprising an artificial turf backing and artificial turf fiber tufted into the artificial turf backing. The artificial turf backing may for instance be a textile or other flat structure which is able to have fibers tufted into it. The artificial turf fiber comprises at least one monofilament. Each of the at least one monofilament comprises a first polymer in the form of thread-like regions. Each of the at least one monofilament comprises a second polymer, wherein the thread-like regions are embedded in the second polymer. Each of the at least one monofilaments comprises a compatibilizer surrounding each of the thread-like regions and separating the at least one first polymer from the second polymer. This artificial turf may have the advantage of being extremely durable because the thread-like regions are embedded within the second polymer via a compatibilizer. They therefore do not have the ability to delaminate. Having the second polymer surrounding the first polymer may provide for a stiff artificial turf that is soft and feels similar to real turf. The artificial turf as described herein is distinct from artificial turf which is coextruded. In coextrusion a core of typically 50 to 60 micrometer may be surrounded by an outer cover or sheathing material which has a diameter of approximately 200 to 300 micrometer in diameter.

In embodiments where the bulk polymer is formed from a mixture of at least the first and second polymer the artificial turf has a large number of thread-like regions of the first polymer and possibly the third polymer. The thread-like regions may not continue along the entire length of the monofilament. The artificial turf may also have properties or features which are provided for by any of the aforementioned method steps.

In another embodiment the thread-like regions have a diameter of less than 20 micrometer.

In another embodiment the thread-like regions have a diameter of less than 10 micrometer.

In another embodiment the thread-like regions have a diameter of between 1 and 3 micrometer.

In another embodiment the artificial turf fiber extends a predetermined length beyond the artificial turf backing. The thread-like regions have a length less than one half of the predetermined length.

In another embodiment the thread-like regions have a length of less than 2 mm.

In another embodiment, the aramid is para-aramid. The use of para-Aramid fibers may have the benefit of providing for greater thermal stability.

The use of para-Aramid may also have additional benefit. For example the para-Aramid may increase the temperature resistance of the bulk polymer. The high thermal resistance of the para-Aramid enables it to absorb more energy. This may then cause the bulk polymer to deform at a higher temperature than if the para-Aramid were not used.

When artificial turf burns, an intumescence layer may cover the surface of any artificial turf fibers or monofilaments and thus if the monofilament or fibers used to make the artificial turf melt then the intumescence layer is less effective in stopping a fire. The para-Aramid may therefore increases the effectiveness of the intumescence layer in stopping a fire because it provides more stability at the higher temperatures caused by the fire. This may keep the intumescence layer intact which may lead to a self extinguishing effect in the case of fire.

Both aramid and para-Aramid have high mechanical strength and resist mechanical wear. Artificial turf made with para-Aramid may possibly be used for a longer time before it wears out in comparison with conventional artificial turfs.

In another embodiment, the para-Aramid has a fiber length less than any one of the following: 135 μm, 125 μm, and 115 μm.

In another embodiment, the para-Aramid has an average fiber length of any one of the following: between 65 μm and 35 um, and 55 μm.

In another embodiment, the para-Aramid has a density between any one of the following: 1.44 g/cm$^3$ and 1.45 g/cm$^3$, and 1.43 g/cm$^3$ and 1.46 g/cm$^3$.

In another embodiment, the para-Aramid has a decomposition temperature of any one of the following: above 720 degrees, above 725 degrees, and 723 degrees Kelvin.

It is understood that one or more of the aforementioned embodiments of the invention may be combined as long as the combined embodiments are not mutually exclusive.

BRIEF DESCRIPTION OF THE DRAWINGS

In the following embodiments of the invention are explained in greater detail, by way of example only; making reference to the drawings in which.

DETAILED DESCRIPTION

Like numbered elements in these figures are either equivalent elements or perform the same function. Elements which have been discussed previously will not necessarily be discussed in later figures if the function is equivalent.

Figure 1:
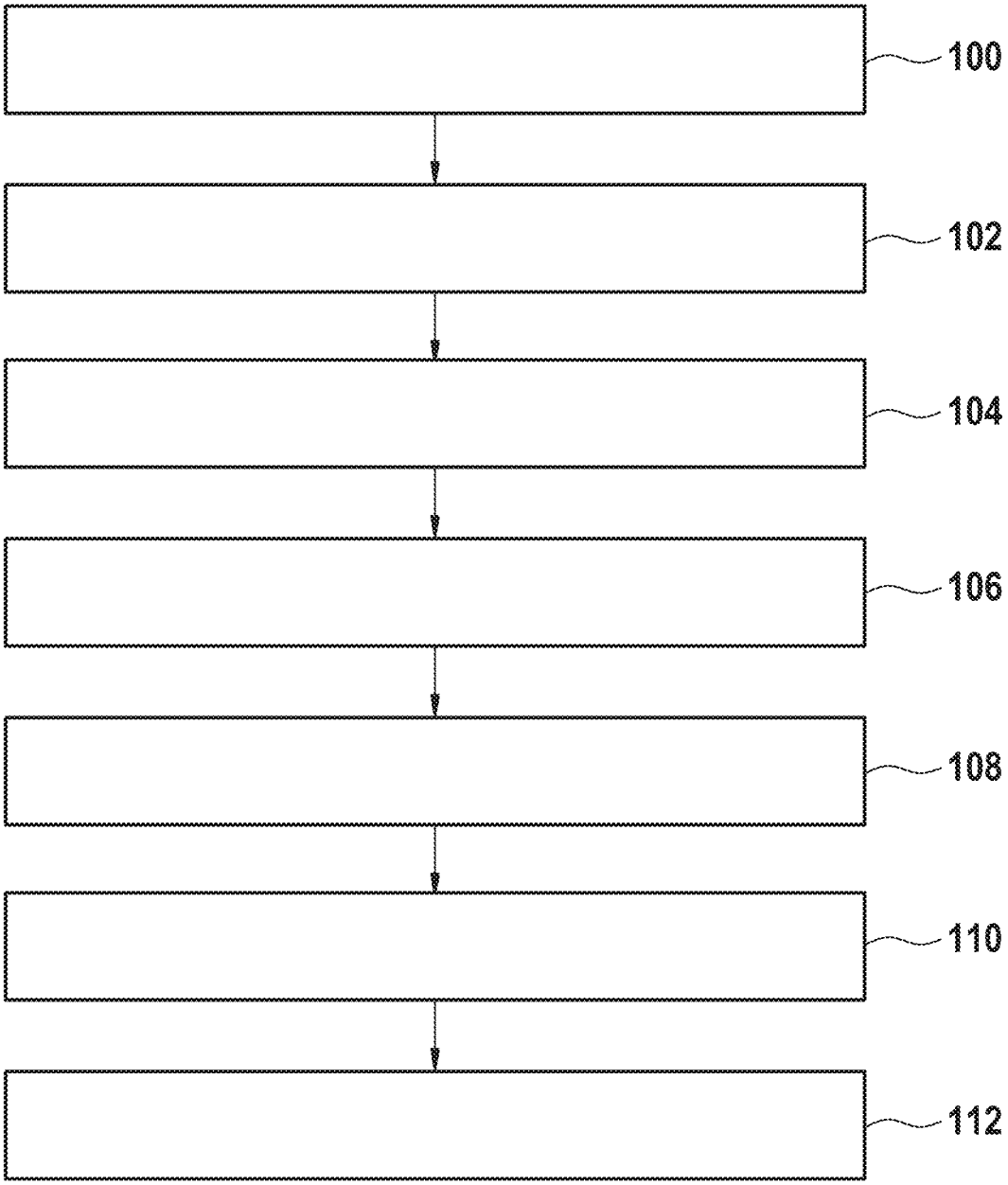
FIG. 1 shows a flowchart which illustrates an example of a method of manufacturing artificial turf.

FIG. 1 shows a flowchart which illustrates an example of a method of manufacturing artificial turf. First in step 100 a polymer mixture is created. The polymer mixture comprises a bulk polymer, a stabilizing polymer, a flame retardant polymer combination, and a compatiblizer. In some instances the bulk polymer may be made of multiple components. The stabilizing polymer is immiscible in the bulk polymer, and therefore the stabilizing polymer is surrounded by the compatibilizer. The stabilizing polymer is formed from fibers of aramid.

In some examples, the bulk polymer comprises a first polymer. The bulk polymer further comprises a second polymer and a compatibilizer. The first polymer and the second polymer are immiscible. In other examples there may be additional polymers such as a third, fourth, or even fifth polymer that are also immiscible with the second polymer. There also may be additional compatibilizers which are used either in combination with the first polymer or the additional third, fourth, or fifth polymer. The first polymer forms polymer beads surrounded by the compatibilizer. The polymer beads may also be formed by additional polymers which are not miscible in the second polymer. The polymer beads are also surrounded by the compatibilizer and are within the second polymer or mixed into the second polymer.

In the next step 102 the bulk polymer is extruded into a monofilament. Next in step 104 the monofilament is quenched or rapidly cooled down. Next in step 106 the monofilament is reheated. In step 108 the reheated monofilament is stretched this causes the fibers of the stabilizing polymer to become aligned with each other which is in the direction that the fibers are stretched. If the bulk polymer comprises the polymer beads, the stretching deforms the polymer beads into thread-like regions and to form the monofilament into the artificial turf fiber.

Additional steps may also be performed on the monofilament to form the artificial turf fiber. For instance the monofilament may be spun or woven into a yarn with desired properties. Next in step 110 the artificial turf fiber is incorporated into an artificial turf backing. Step 110 could for example be, but is not limited to, tufting or weaving the artificial turf fiber into the artificial turf backing. Then in step 112 the artificial turf fibers are bound to the artificial turf backing. For instance the artificial turf fibers may be glued or held in place by a coating or other material. Step 112 is an optional step. For example if the artificial turf fibers are woven into the artificial turf backing step 112 may not need to be performed.

Figure 2:
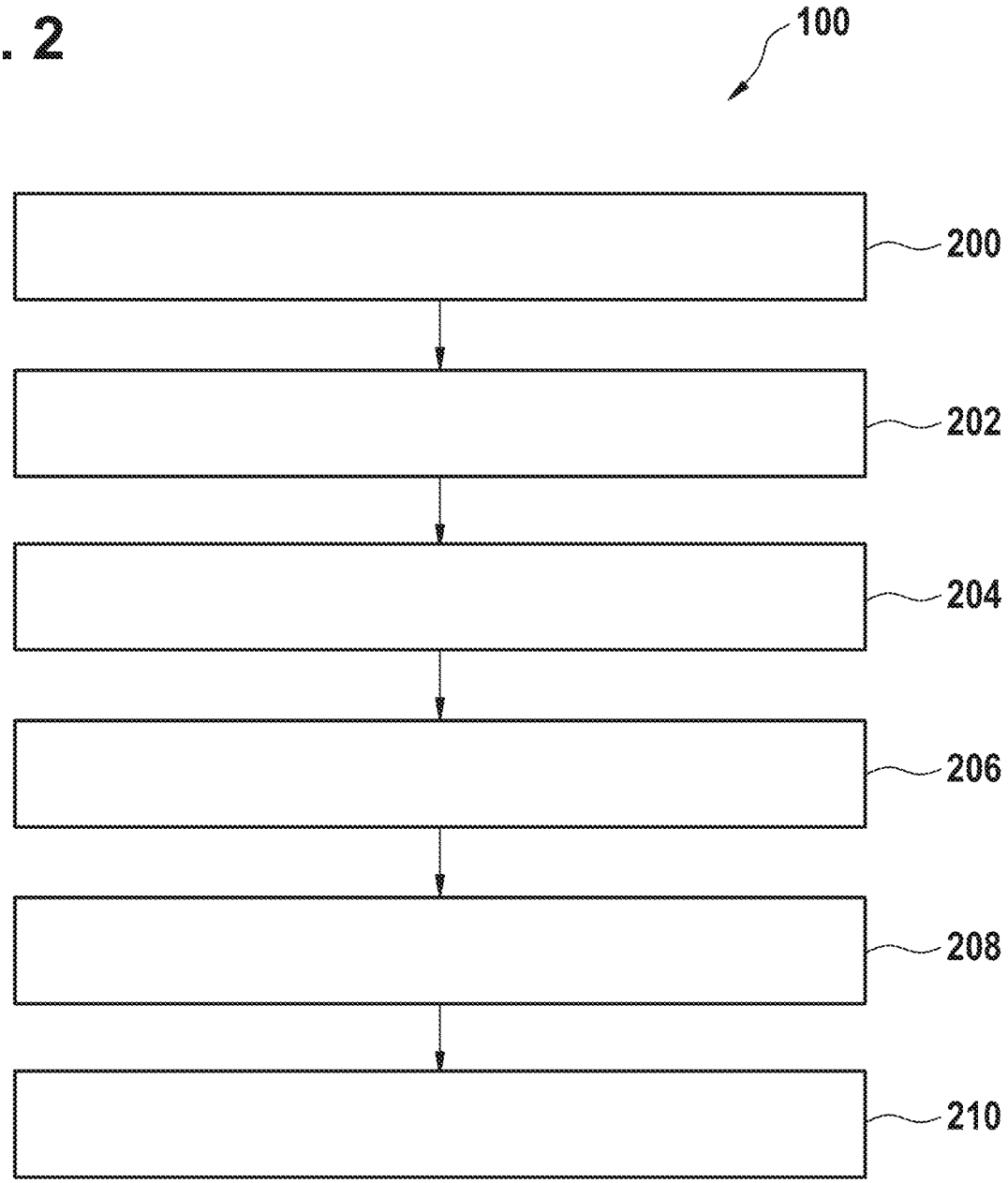
FIG. 2 shows a flowchart which illustrates one method of creating the polymer mixture.

FIG. 2 shows a flowchart which illustrates one method of creating the bulk polymer. In this example the bulk polymer comprises the first polymer, a second polymer, and the compatibilizer. The bulk polymer may also comprise other things such as additives to color or provide flame or UV-resistance or improve the flowing properties of the bulk polymer. First in step 200 a first mixture is formed by mixing the first polymer with the compatibilizer. Additional additives may also be added during this step. Next in step 202 the first mixture is heated. Next in step 204 the first mixture is extruded. Then in step 206 the extruded first mixture is then granulated or chopped into small pieces. Next in step 208 the granulated first mixture is mixed with the second polymer. Additional additives may also be added to the bulk polymer at this time. Finally in step 210 the granulated first mixture is heated with the second polymer to form the bulk polymer. The heating and mixing may occur at the same time. The bulk polymer can be fabricated separately and then later added together to the stabilizing polymer and more compatibilizer, or the bulk polymer can be fabricated at the same time as the polymer mixture.

Figure 3:
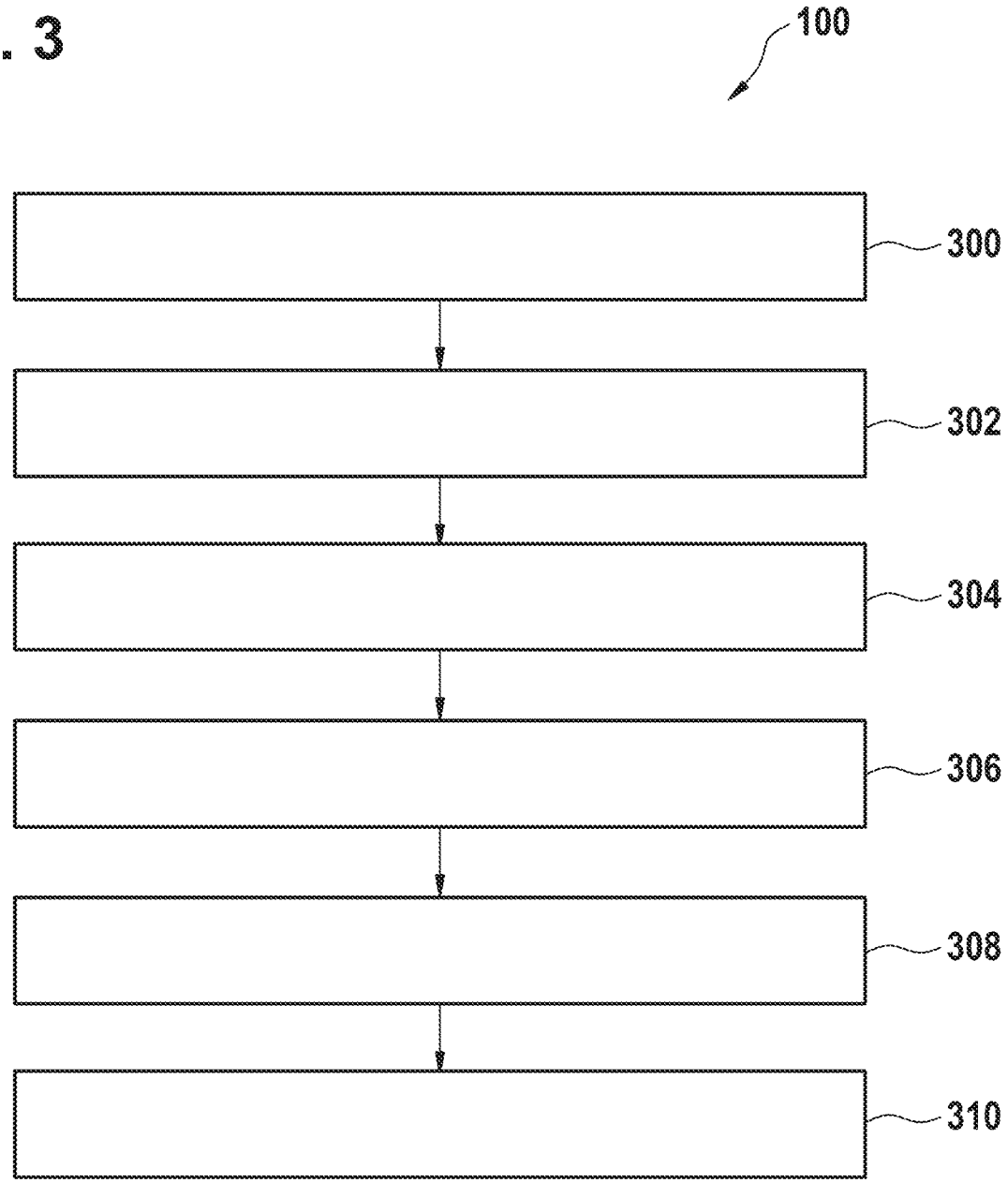
FIG. 3 shows a flowchart which illustrates a further example of how to create a polymer mixture.

FIG. 3 shows a flowchart which illustrates an example of how to create a bulk polymer 100. In this example the bulk polymer additionally comprises at least a third polymer. The third polymer is immiscible with The third polymer further forms the polymer beads surrounded by the compatibilizer with the second polymer. First in step 300 a first mixture is formed by mixing the first polymer and the third polymer with the compatibilizer. Additional additives may be added to the first mixture at this point. Next in step 302 the first mixture is heated. The heating and the mixing of the first mixture may be done at the same time. Next in step 304 the first mixture is extruded. Next in step 306 the extruded first mixture is granulated or chopped into tiny pieces. Next in step 308 the first mixture is mixed with the second polymer. Additional additives may be added to the bulk polymer at this time. Then finally in step 310 the heated first mixture and the second polymer are heated to form the bulk polymer. The heating and the mixing may be done simultaneously. The bulk polymer can be fabricated separately and then later added together to the stabilizing polymer and more compatibilizer, or the bulk polymer can be fabricated at the same time as the polymer mixture.

Figure 4:
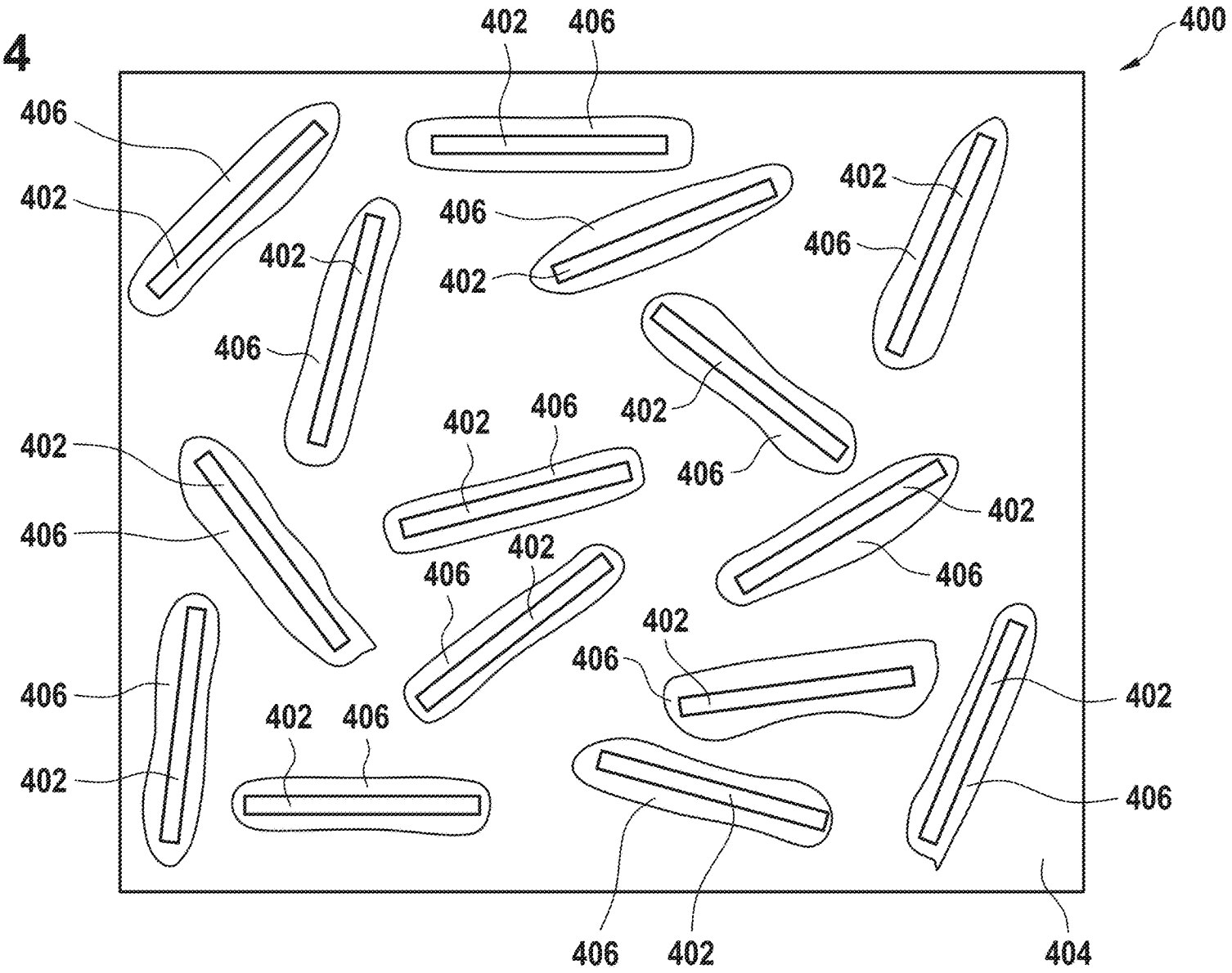
FIG. 4 shows a diagram which illustrates a cross-section of a polymer mixture.

FIG. 4 shows a diagram which illustrates a cross-section of a polymer mixture 400. The polymer mixture comprises a number of stabilizing polymer 402. These are shown as being in the form of aramid fibers. The bulk of the polymer mixture 400 is shown as being the bulk polymer 404. Each of the stabilizing polymer 402 fibers is surrounded by a compatibilizer 406. This enables the stabilizing polymer 402 to be mixed with the bulk polymer 404. The flame-retardant polymer is not shown but may be considered to be mixed into the bulk polymer 404.

Figure 5:
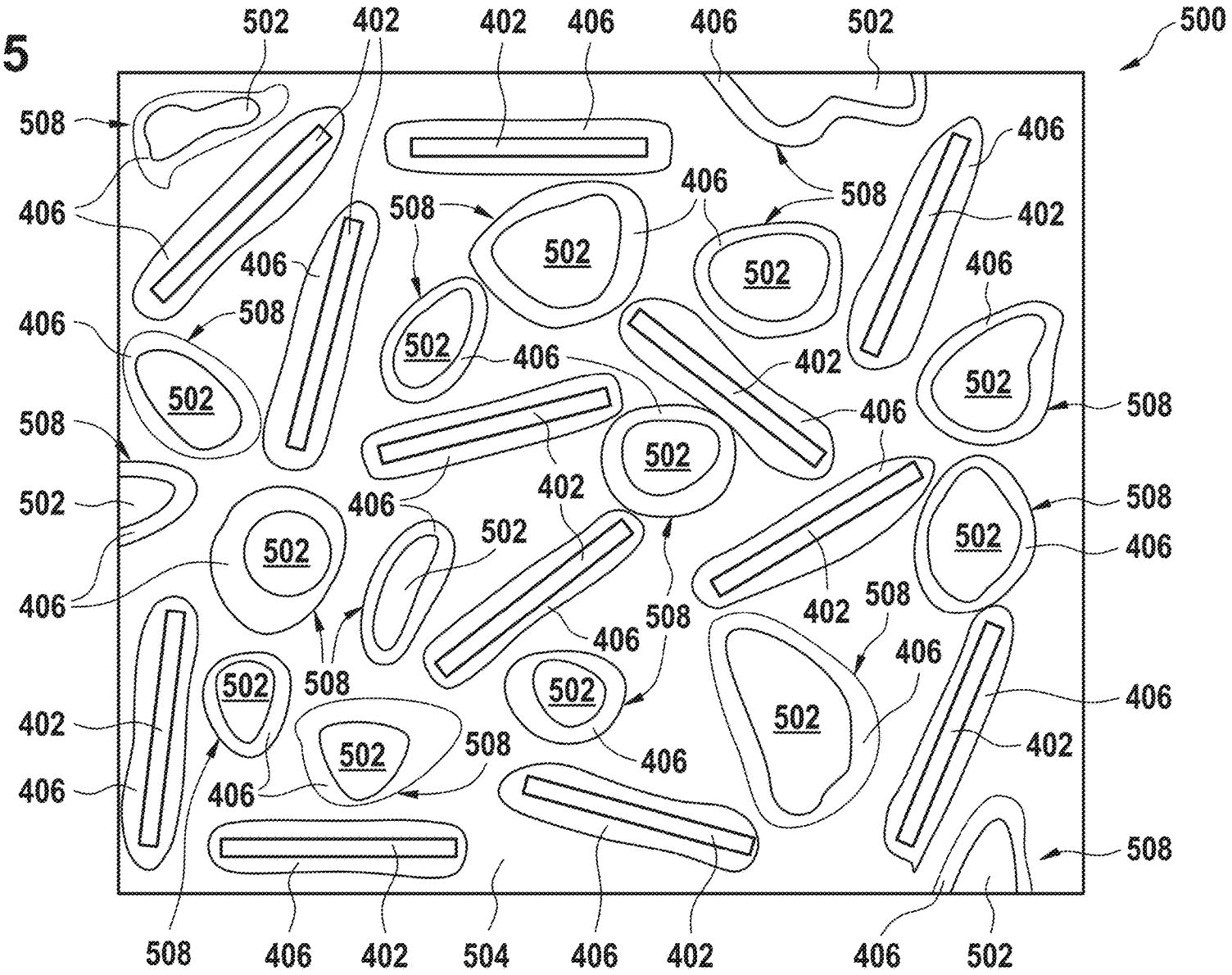
FIG. 5 shows a diagram which illustrates a cross-section of a further example of polymer mixture.

FIG. 5 shows a further example of a cross-section of a polymer mixture 500. In this example the bulk polymer is made up of two different polymers. It is made up of a non-polar second polymer 504 and a polar first polymer 502. There is less of the first polymer 502 than the second polymer 504. The first polymer 502 is shown as also being surrounded by the compatibilizer 406 so that it is able to be mixed into the second polymer 504. The first polymer 502 surrounded by the compatibilizer 406 forms a number of polymer beads 508. The polymer beads 508 may be spherical or oval in shape or they may also be irregularly-shaped depending up on how well the polymer mixture is mixed and the temperature. The compatibilizer 406 separates the first polymer 402 from the second polymer 406.

Figure 6:
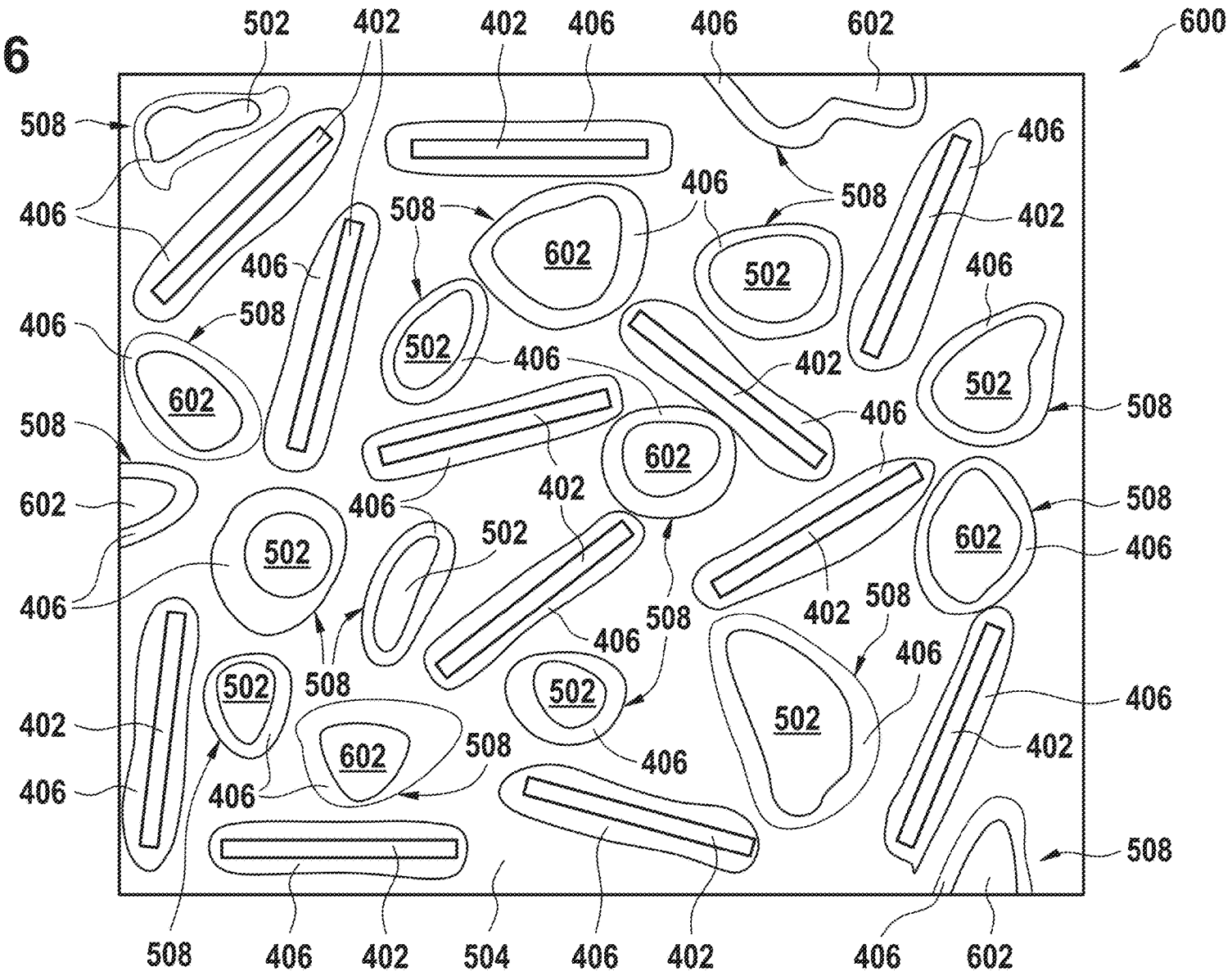
FIG. 6 shows a diagram which illustrates a cross-section of a further example of polymer mixture.

FIG. 6 shows a further cross-section of an additional polymer mixture. The polymer mixture 600 in FIG. 6 has a bulk polymer which is made up of the second polymer 504 and the first polymer 502 as shown in FIG. 5 but in addition there is a third polymer 602 which is also immiscible with the second polymer 504. The third polymer 602 is also shown as being surrounded by the compatibilizer 406 so that it can be mixed with the second polymer 504. Some of the polymer beads 508 are now comprised of the third polymer 602.

In this example the same compatibilizer 506 is used for both the first polymer 502 and the third polymer 602. In other examples a different compatibilizer 506 could be used for the first polymer 502 and the third polymer 602.

Figure 7:
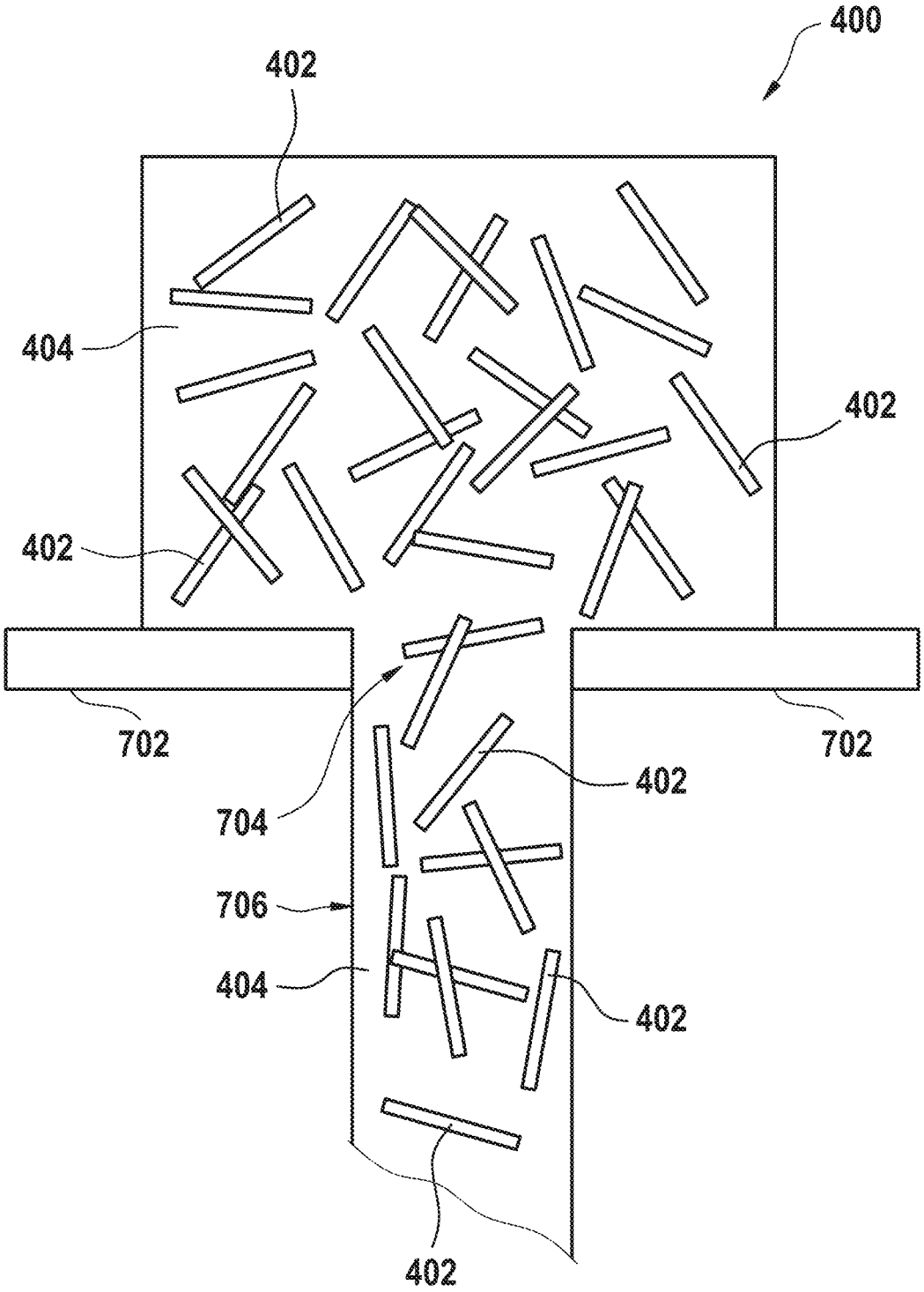
FIG. 7 illustrates the extrusion of the polymer mixture of FIG. 4 into a monofilament.
Figure 8:
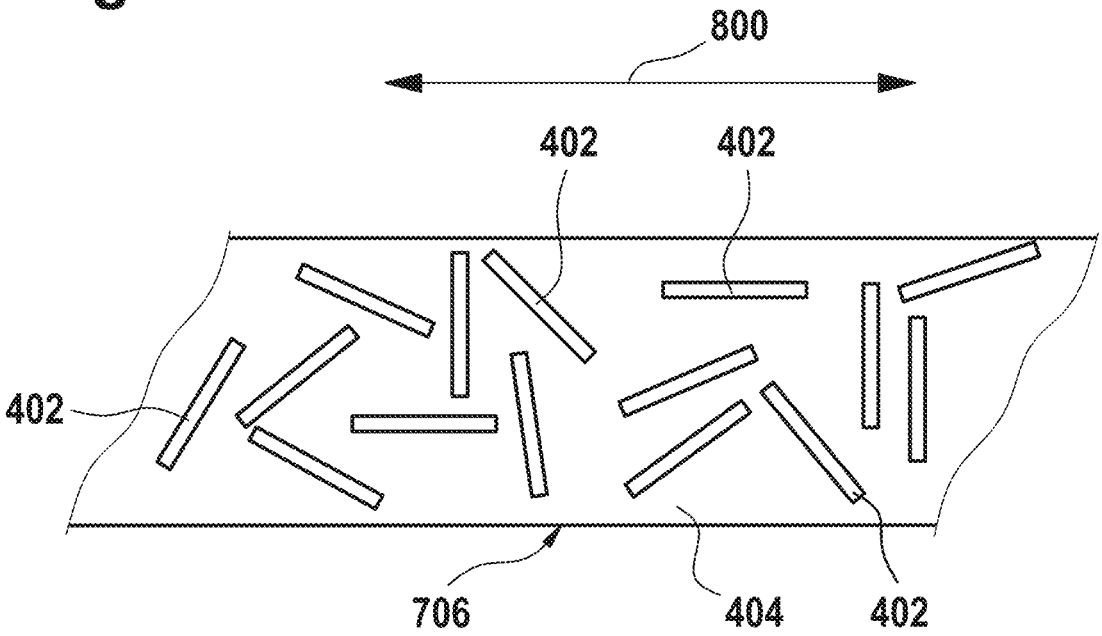
FIG. 8 shows a cross-section of a small segment of the monofilament of FIG. 7.

FIG. 7 illustrates the extrusion of the polymer mixture 400 into a monofilament. Shown is an amount of bulk polymer 404. Within the polymer mixture 400 there is a large number of fibers 402 of the stabilizing polymer. A screw, piston or other device is used to force the polymer mixture 400 through a hole 704 in a plate 702. This causes the polymer mixture 400 to be extruded into a monofilament 706. The monofilament 706 is shown as containing the fibers 402 also. The fibers 402 may tend to concentrate in the center of the monofilament 706. This may lead to desirable properties for the final artificial turf fiber as this may lead to a concentration of the thread-like regions in the core region of the monofilament 706, FIG. 8 shows a cross-section of a small segment of the monofilament 706. The monofilament is again shown as comprising the bulk polymer 404 with the fibers 402 mixed in. The fibers 402 are separated from the bulk polymer 404 by compatibilizer which is not shown. To form the thread-like structures a section of the monofilament 706 is heated and then stretched along the length of the monofilament 706. This is illustrated by the arrows 800 which show the direction of the stretching.

Figure 9:
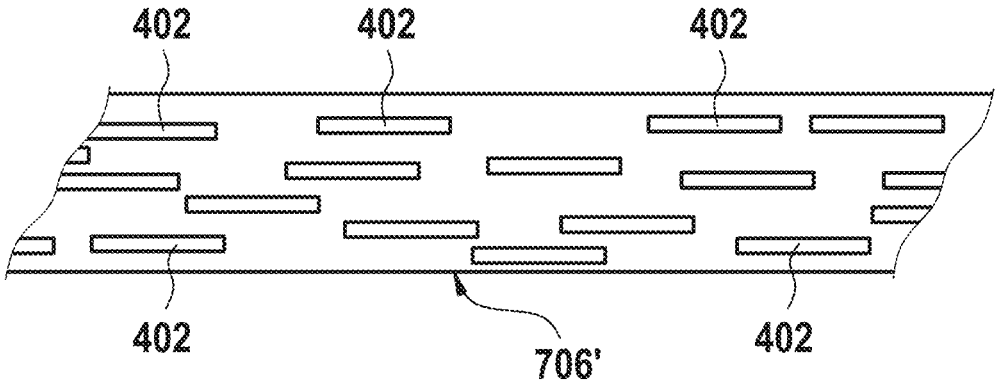
FIG. 9 illustrates the effect of stretching the monofilament of FIG. 8.

FIG. 9 illustrates the effect of stretching the monofilament 706. In FIG. 8 an example of a cross-section of a stretched monofilament 706 is shown. The fibers 402 in FIG. 8 have been aligned with each other or in the direction of the stretching 800.

Figure 10:
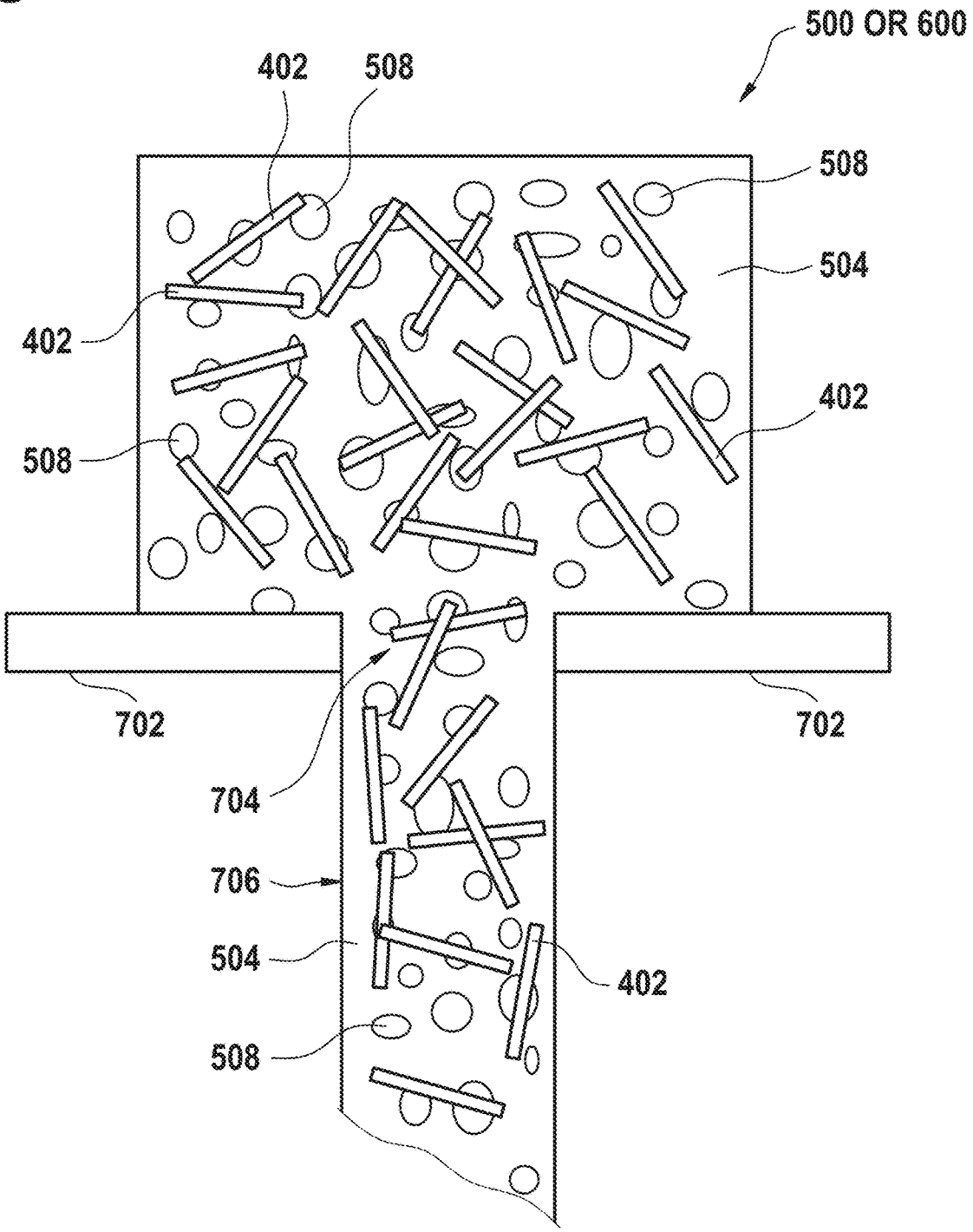
FIG. 10 illustrates the extrusion of the polymer mixture of FIG. 5 or 6 into a monofilament.

FIG. 10 shows a Fig. that is similar to that of FIG. 7 except in FIG. 10 the polymer mixture 500 of FIG. 5 or the polymer mixture 600 of FIG. 6 is used in place of the polymer mixture 400. The polymer mixture can be seen as containing the polymer beads 508 and the stabilizing polymer 402 fibers mixed into the second polymer 504. The polymer mixture 500 or 600 is extruded in the same way into the monofilament 706.

Shown is an amount of 500 or 600. Within the bulk polymer 500 or 600 there is a large number of polymer beads 508. The polymer beads 508 may be made of one or more polymers that is not miscible with the second polymer 504 and is also separated from the second polymer 504 by a compatibilizer, which is not shown. A screw, piston or other device is used to force the bulk polymer 500 or 600 through a hole 704 in a plate 702. This causes the 500 or 600 to be extruded into a monofilament 706. The monofilament 706 is shown as containing polymer beads 508 also in addition to the fibers 402. The second polymer 504, the fibers 402, and the polymer beads 508 are extruded together. In some examples the second polymer 504 will be less viscous than the polymer beads 508 and the polymer beads 508 will tend to concentrate in the center of the monofilament 706. This may lead to desirable properties for the final artificial turf fiber as this may lead to a concentration of the thread-like regions in the core region of the monofilament 706.

Figure 11:
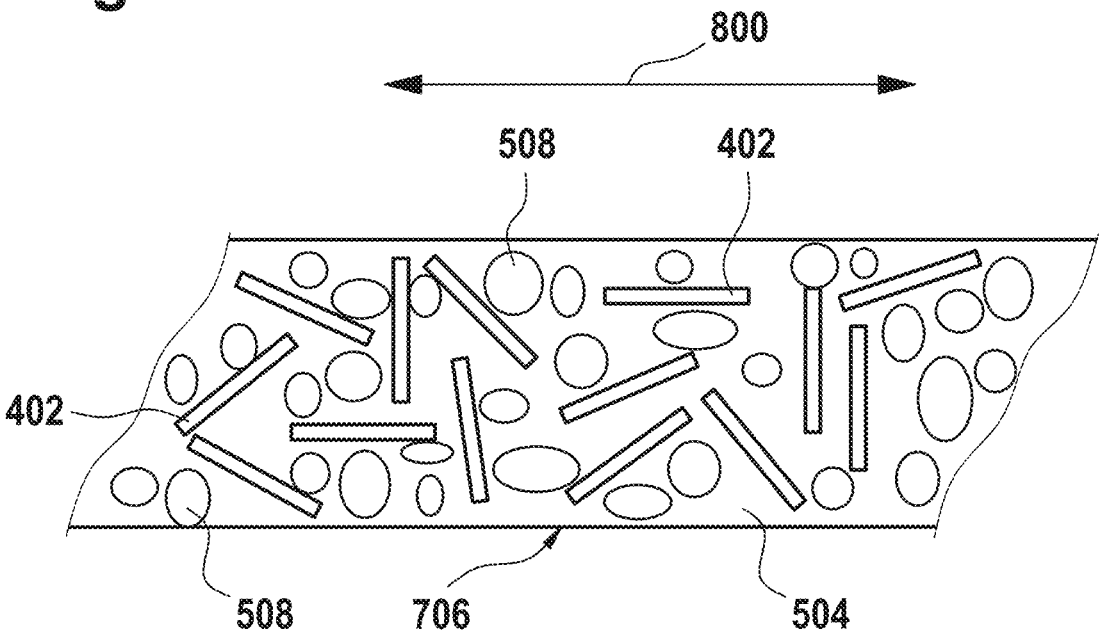
FIG. 11 shows a cross-section of a small segment of the monofilament of FIG. 10.

FIG. 11 is similar to FIG. 8 except the monofilament 706 of FIG. 10 is used instead. The monofilament 706 is shown before being stretched in the direction 800. The fibers of the stabilizing polymer 402 are shown as being in more or less random directions and the polymer beads 508 are oddly-shaped and have not yet been formed into the threadlike structures. To form the thread-like structures a section of the monofilament 706 is heated and then stretched along the length of the monofilament 706. This is illustrated by the arrows 800 which show the direction of the stretching.

Figure 12:
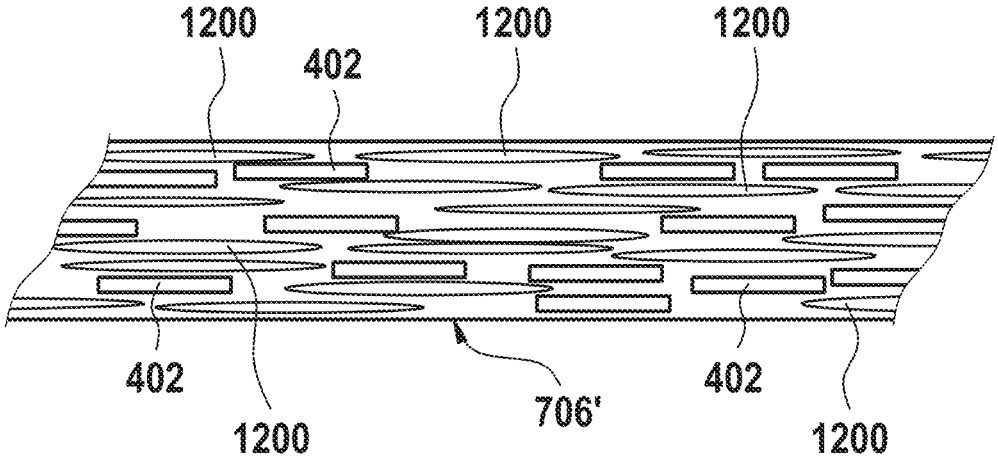
FIG. 12 illustrates the effect of stretching the monofilament of FIG. 11.

FIG. 12 shows the monofilament 706' after it has been stretched in the direction 800 illustrated in FIG. 11. The stretching motion causes the fibers of the stabilizing polymer 402 to roughly align with the stretching direction 800 and also the polymer beads 508 of FIG. 11 have been stretched into threadlike structures 1200. FIG. 12 illustrates the effect of stretching the monofilament 606. In FIG. 8 an example of a cross-section of a stretched monofilament 606 is shown. The polymer beads 408 in FIG. 7 have been stretched into thread-like structures 1200. The amount of deformation of the polymer beads 408 would be dependent upon how much the monofilament 706' has been stretched.

Examples may relate to the production of artificial turf which is also referred to as synthetic turf. In particular, the invention relates to the production of fibers that imitate grass. The fibers are composed of first and second polymers that are not miscible and differ in material characteristics as e.g. stiffness, density, polarity and a compatibilizer.

In a first step for manufacturing the bulk polymer, a first polymer is mixed with the a compatibilizer. Color pigments, UV and thermal stabilizers, process aids and other substances that are as such known from the art can be added to the mixture.

In a second step for manufacturing the bulk polymer, the second polymer is added to the mixture whereby in this example the quantity of the second polymer is about 80-90 mass of the bulk polymer or the polymer mixture, the quantities of the first polymer being 5% to 10% by mass and of the compatibilizer being 5% to 10% by mass. Using extrusion technology results in a mixture of droplets or of beads of the first polymer surrounded by the compatibilizer that is dispersed in the polymer matrix of the second polymer.

In a practical implementation a so called master batch including granulate of the bulk polymer, the stabilizing polymer, and the compatibilizer is formed. The master batch may also be referred to as a "polymer mixture" herein. The granulate mix is melted and a mixture of the first polymer and the compatibilizer is formed by extrusion. The resulting strands are crushed into granulate. The resultant granulate and granulate is then used in a second extrusion to produce the thick fiber which is then stretched into the final fiber.

The melt temperature used during extrusions is dependent upon the type of polymers and compatibilizer that is used. However the melt temperature is typically between 230° C. and 280° C.

A monofilament, which can also be referred to as a filament or fibrillated tape, is produced by feeding the mixture into an fiber producing extrusion line. The melt mixture is passing the extrusion tool, i.e., a spinneret plate or a wide slot nozzle, forming the melt flow into a filament or tape form, is quenched or cooled in a water spin bath, dried and stretched by passing rotating heated godets with different rotational speed and/or a heating oven.

The monofilament or type is then annealed online in a second step passing a further heating oven and/or set of heated godets.

By this procedure the beads or droplets of polymer 1, surrounded by the compatibilizer are stretched into longitudinal direction and form small fiber like, linear structures which stay however completely embedded into the polymer matrix of the second polymer.

Figure 13:
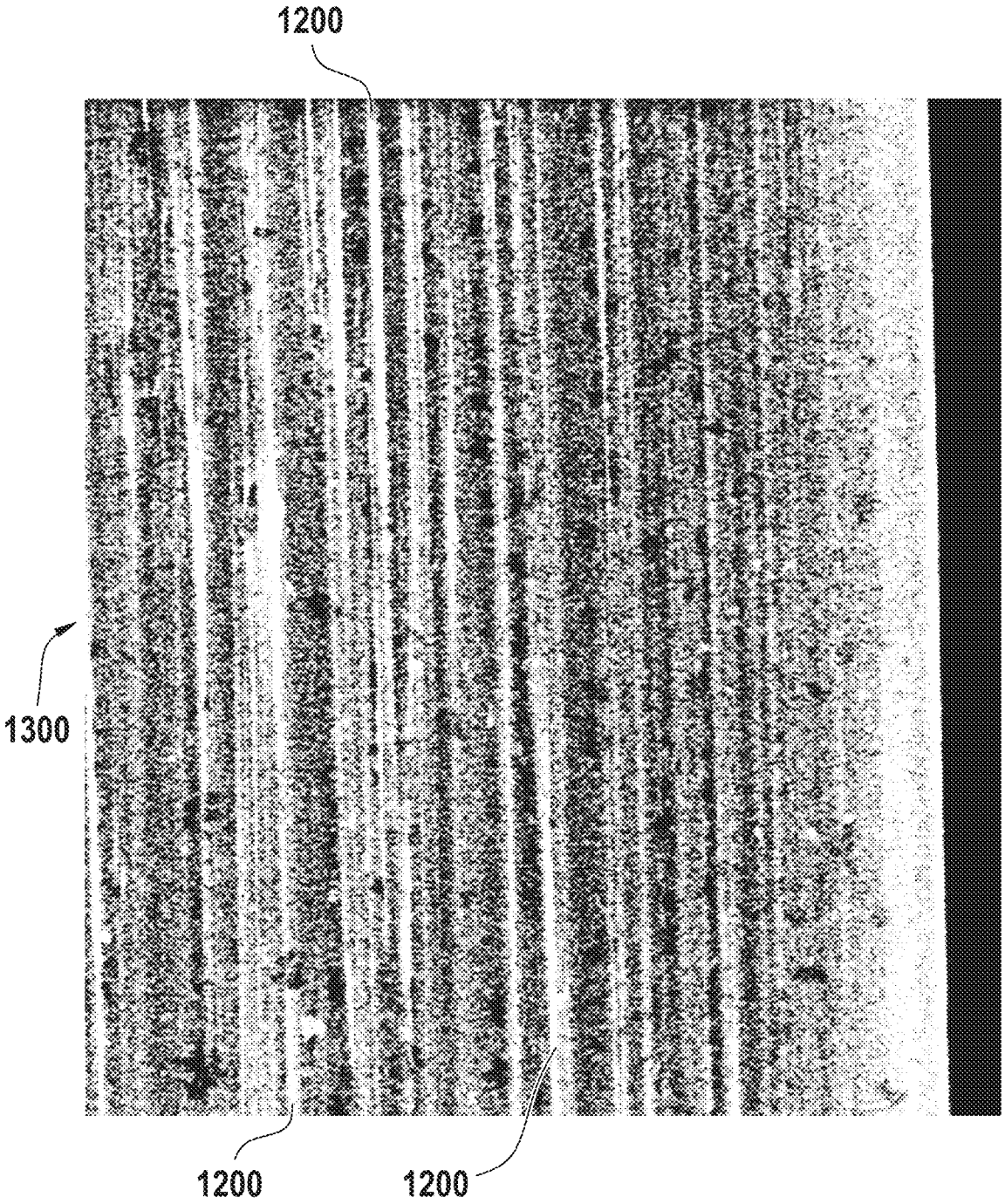
FIG. 13 shows an electron microscope picture of a cross-section of a stretched monofilament.

FIG. 13 shows a microscopic picture of a cross-section 1300 of a stretched monofilament to illustrate the thread like structures. The fibers of the stabilizing polymer are not shown. The horizontal white streaks within the stretched monofilament 706 are the thread-like structures 1200. Several of these thread-like structures are labeled 1200. The thread-like structures 1200 can be shown as forming small linear structures of the first polymer within the second polymer.

The resultant fiber that contains the thread like structures may have multiple advantages, namely softness combined with durability and long term elasticity. In case of different stiffness and bending properties of the polymers the fiber can show a better resilience (this means that once a fiber is stepped down it will spring back) In case of a stiff first polymer, the small linear fiber structures built in the polymer matrix are providing a polymer reinforcement of the fiber.

Delimitation due to the composite formed by the first and second polymers is prevented due to the fact that the short fibers of the second polymer are embedded in the matrix given by the first polymer. The same is true for the fibers of the stabilizing polymer. Moreover, complicated coextrusion, requiring several extrusion heads to feed one complex spinneret tool is not needed.

The first polymer can be a polar substance, such as polyimide, whereas the second polymer can be a non-polar polymer, such as polyethylene. Alternatives for the first polymer are polyethylene terephthalate (PET) or polybutylene terephthalate (PBT) for the second polymer polypropylene. Finally a material consisting of 3 polymers is possible (e.g. PET, PA and PP, with PP creating the matrix and the other creating independent from each other fibrous linear structures. The compatibilizer can be a maleic anhydride grafted on polyethylene or polyamide.

Figure 14:
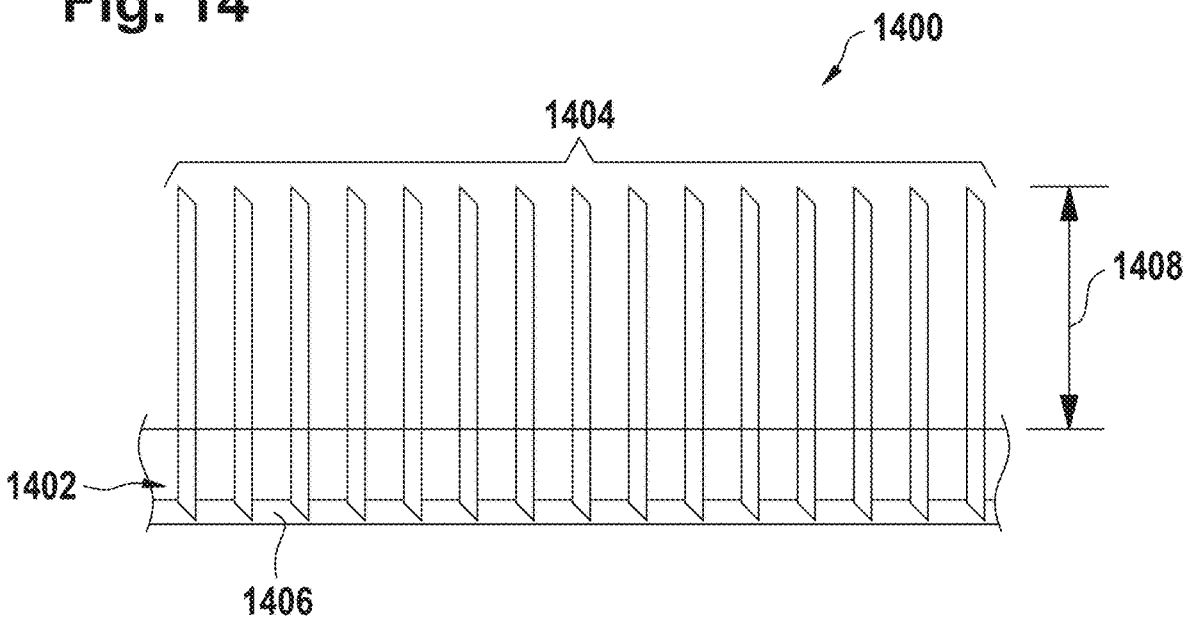
FIG. 14 shows an example of a cross-section of an example of artificial turf.

FIG. 14 shows an example of a cross-section of an example of artificial turf 1400. The artificial turf 1400 comprises an artificial turf backing 1402. Artificial turf fiber 1404 has been tufted into the artificial turf backing 1402. On the bottom of the artificial turf backing 1402 is shown a coating 1406. The coating may serve to bind or secure the artificial turf fiber 1404 to the artificial turf backing 1402. The coating 1406 may be optional. For example the artificial turf fibers 1404 may be alternatively woven into the artificial turf backing 1402. Various types of glues, coatings or adhesives could be used for the coating 1406. The artificial turf fibers 1404 are shown as extending a distance 1408 above the artificial turf backing 1402. The distance 1008 is essentially the height of the pile of the artificial turf fibers 1404. In some examples, the length of the thread-like regions within the artificial turf fibers 1404 is half of the distance 1408 or less.

LIST OF REFERENCE NUMERALS

100 create a bulk polymer
102 extrude the bulk polymer into a monofilament
104 quench the monofilament
106 reheat the monofilament
108 stretch the reheated monofilament
110 incorporate the artificial turf fiber into an artificial turf carpet
112 optionally bind the artificial turf fibers to the artificial turf carpet
200 form a first mixture by mixing the first polymer with the compatibilizer
202 heat the first mixture
204 extrude the first mixture
206 granulate the extruded first mixture
208 mix the granulated first mixture with the second polymer
210 heat the granulated first mixture with the second polymer to form the bulk polymer
300 form a first mixture by mixing the first polymer and the third polymer with the compatibilizer
302 heat the first mixture
304 extrude the first mixture
306 granulate the extruded first mixture
308 mix the first mixture with the second polymer
310 heat the mixed first mixture with the second polymer to form the bulk polymer
400 polymer mixture
402 stabilizing polymer
404 bulk polymer
406 compatibilizer
500 polymer mixture
502 first polymer
504 second polymer
406 compafibilizer
508 polymer bead
600 polymer mixture
602 third polymer
700 bulk polymer
702 plate
704 hole
706 monofilament
706' stretched monofilament
800 direction of stretching
1200 threadlike structures
1400 artificial turf
1402 artificial turf carpet
1404 artificial turf fiber (pile)
1406 coating
1408 height of pile

The invention claimed is:

1. A method of manufacturing artificial turf, the method comprising:

creating a polymer mixture, wherein the polymer mixture comprises a stabilizing polymer, a bulk polymer comprising a first polymer, a second polymer and a compatibilizer, and a flame retardant polymer combination, wherein the stabilizing polymer and the bulk polymer are immiscible, wherein the stabilizing polymer comprises fibers surrounded by the compatibilizer within the bulk polymer, wherein the stabilizing polymer is aramid, wherein the flame retardant polymer combination is a mixture of triazine and melamine, and wherein the first polymer, the second polymer and the stabilizing polymer are immiscible, wherein the first polymer forms polymer beads surrounded by the compatibilizer within the second polymer;

extruding the polymer mixture into a monofilament;

quenching the monofilament;

reheating the monofilament;

stretching the reheated monofilament to align the fibers relative to each other and to form the monofilament into an artificial turf fiber; and incorporating the artificial turf fiber into an artificial turf backing, wherein creating the polymer mixture comprises mixing the stabilizing polymer surrounded by the compatibilizer with the bulk polymer.

2. The method of claim 1, wherein the polymer mixture comprises any one of the following: less than or equal to 8% stabilizing polymer by weight, less than or equal to 10% stabilizing polymer by weight, less than or equal to 12% stabilizing polymer by weight, or less than or equal to 15% stabilizing polymer by weight.

3. The method of claim 1, wherein the polymer mixture comprises any one of the following: less than or equal to 20% flame retardant polymer combination by weight, less than or equal to 22% flame retardant polymer combination by weight, less than or equal to 25% flame retardant polymer combination by weight, less than or equal to 27% flame retardant polymer combination by weight, or less than or equal to 29% flame retardant polymer combination by weight.

4. The method of claim 1, wherein the ratio of triazine to melamine by weight in the flame retardant polymer combination is any one of the following: 1.8, 1.9, 2.0, 2.1, or 2.2.

5. The method of claim 1, wherein stretching the reheated monofilament deforms the polymer beads into threadlike regions having a diameter of less than 20 micrometer.

6. The method of claim 1, wherein the creating of the bulk polymer comprises:

forming a first mixture by mixing the first polymer with the compatibilizer;

heating the first mixture;

extruding the first mixture;

granulating the extruded first mixture;

mixing the granulated first mixture with the second polymer; and heating the granulated first mixture with the second polymer to form the polymer mixture.

7. The method of claim 1, wherein the bulk polymer comprises any one of the following: 1 to 30 percent by weight the first polymer, 1 to 20 percent by weight the first polymer, or 5 to 10 percent by weight the first polymer.

8. The method of claim 1, wherein the first polymer is any one of the following: a polar polymer, a polyethylene terephthalate (PET) polymer, a polybutylene terephthalate (PBT) polymer, a polyolefin polymer, a thermoplastic polyolefin polymer, a polyethylene polymer, a polypropylene polymer, a polyamide polymer, a polyethylene polymer blend, or mixtures thereof.

9. The method of claim 1, wherein the second polymer is any one of the following: a non-polar polymer, polyethylene, polypropylene, or a mixture thereof.

10. The method of claim 1, wherein the compatibilizer is any one of the following: a maleic acid grafted on polyethylene or polyamide; a maleic anhydride grafted on free radical initiated graft copolymer of polyethylene, SEES, EVA, EPD, or polypropylene with an unsaturated acid or its anhydride such as maleic acid, glycidyl methacrylate, ricinoloxazoline maleinate; a graft copolymer of SEBS with glycidyl methacrylate, a graft copolymer of EVA with mercaptoacetic acid and maleic anhydride; a graft copolymer of EPDM with maleic anhydride; a graft copolymer of polypropylene with maleic anhydride; a polyolefin-graft-polyamidepolyethylene or polyamide; or a polyacrylic acid type compatibilizer.

11. The method of claim 1, wherein the bulk polymer comprises 80 to 90 percent by weight the second polymer.

12. The method of claim 1, wherein the polymer mixture further comprises any one of the following: a wax, a dulling agent, a UV stabilizer, a flame retardant, an anti-oxidant, a pigment, or any combination thereof.

13. The method of claim 1, wherein the aramid is para-aramid.

14. The method of claim 13, wherein the para-aramid has a fiber length less than any one of the following: 135 μm, 125 μm, or 115 μm.

15. The method of claim 13, wherein the para-aramid has an average fiber length of any one of the following: between 65 μm and 35 μm, or 55 μm.

16. The method of claim 13, wherein the para-aramid has a density between any one of the following: 1.44 g/cm$^3$ and 1.45 g/cm$^3$, or 1.43 g/cm3 and 1.46 g/cm3.

17. The method of claim 13, wherein the para-aramid has a decomposition temperature of any one of the following: above 720 degrees, above 725 degrees, or 723 degrees Kelvin.

18. The method of claim 1, wherein creating the polymer mixture comprises:

forming an initial mixture by mixing the stabilizing polymer with the compatibilizer;

heating the initial mixture;

extruding the initial mixture;

granulating the extruded initial mixture;

mixing the granulated initial mixture with the bulk polymer and the flame-retardant polymer combination; and heating the granulated initial mixture with the bulk polymer and the flame-retardant polymer combination to form the polymer mixture.

19. A method of manufacturing artificial turf, the method comprising:

creating a polymer mixture, wherein the polymer mixture comprises a stabilizing polymer, a bulk polymer comprising a first polymer, a second polymer and a compatibilizer, and a flame retardant polymer combination, wherein the stabilizing polymer and the bulk polymer are immiscible, wherein the stabilizing polymer comprises fibers surrounded by the compatibilizer within the bulk polymer, wherein the stabilizing polymer is aramid, wherein the flame retardant polymer combination is a mixture of triazine and melamine, wherein the first polymer, the second polymer and the stabilizing polymer are immiscible, and wherein the first polymer forms polymer beads surrounded by the compatibilizer within the second polymer;

extruding the polymer mixture into a monofilament;

quenching the monofilament;

reheating the monofilament;

stretching the reheated monofilament to align the fibers relative to each other and to form the monofilament into an artificial turf fiber; and incorporating the artificial turf fiber into an artificial turf backing, wherein creating the polymer mixture comprises:

forming a master batch including a first granulate of the bulk polymer, the stabilizing polymer and the compatibilizer;

extruding a mixture of the first polymer and the compatibilizer for forming strands; and crushing the strands for forming a second granulate, wherein the first granulate and the second granulate form the polymer mixture.

* * * * *